US009945232B2

(12) United States Patent
Munoz et al.

(10) Patent No.: US 9,945,232 B2
(45) Date of Patent: Apr. 17, 2018

(54) GAS TURBINE BLADE CONFIGURATION

(71) Applicant: Siemens Energy, Inc., Orlando, FL (US)

(72) Inventors: Eric Munoz, Miami Gardens, FL (US); Edwin Lee Kite, Stuart, FL (US); Robert J. McClelland, Palm City, FL (US); Charles M. Evans, Tequesta, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 373 days.

(21) Appl. No.: 14/890,608

(22) PCT Filed: May 12, 2014

(86) PCT No.: PCT/US2014/037657

§ 371 (c)(1),
(2) Date: Nov. 12, 2015

(87) PCT Pub. No.: WO2015/020711

PCT Pub. Date: Feb. 12, 2015

(65) Prior Publication Data

US 2016/0102558 A1 Apr. 14, 2016

Related U.S. Application Data

(60) Provisional application No. 61/825,637, filed on May 21, 2013.

(51) Int. Cl.

| | |
|---|---|
| ***F01D 5/14*** | (2006.01) |
| ***F01D 5/18*** | (2006.01) |
| ***F01D 5/28*** | (2006.01) |

(52) U.S. Cl.

CPC ..... *F01D 5/141* (2013.01); *F01D 5/186* (2013.01); *F01D 5/288* (2013.01); *F05D 2220/32* (2013.01); *F05D 2230/21* (2013.01); *F05D 2240/301* (2013.01); *F05D 2240/80* (2013.01); *F05D 2250/71* (2013.01); *F05D 2250/74* (2013.01); *F05D 2260/202* (2013.01)

(58) Field of Classification Search

CPC ..... F01D 4/141; F04D 29/324

See application file for complete search history.

(56) References Cited

U.S. PATENT DOCUMENTS

| | | | |
|---|---|---|---|
| 6,715,990 | B1 | 4/2004 | Arness et al. |
| 6,779,980 | B1 | 8/2004 | Brittingham et al. |
| 6,854,961 | B2 | 2/2005 | Zhang et al. |
| 6,893,210 | B2 | 5/2005 | Zhang et al. |
| 8,133,030 | B2 | 5/2012 | Grafitti et al. |
| 8,628,299 | B2 | 1/2014 | Ammann et al. |
| 2013/0136606 | A1 | 5/2013 | Smith et al. |
| 2013/0136608 | A1 | 5/2013 | Bielek et al. |
| 2013/0136610 | A1 | 5/2013 | Stein et al. |
| 2013/0136611 | A1 | 5/2013 | Gustafson et al. |

*Primary Examiner* — Jason Shanske
*Assistant Examiner* — Cameron Corday

(57) ABSTRACT

A gas turbine engine blade (22), including an airfoil substrate (10) having an exterior surface, wherein: a base (14) of the airfoil substrate is located at a 0% radial on an inner platform surface (20) and a tip (16) of the airfoil substrate is located at a 100% radial; wherein at the 0% radial a cross-sectional profile of the exterior surface is substantially characterized by nominal X and Y coordinates present in Table 1; and wherein at a 50% radial location a cross-sectional profile of the exterior surface is characterized by nominal X and Y coordinates present in Table 6.

20 Claims, 3 Drawing Sheets

GAS TURBINE BLADE CONFIGURATION

CROSS REFERENCE TO RELATED APPLICATIONS

This application is the US National Stage of International Application No. PCT/US2014/037657 filed May 12, 2014, and claims the benefit thereof. The International Application claims benefit of the 21 May 2013 filing date of U.S. provisional patent application No. 61/825,637. All applications are incorporated by reference herein.

This application claims benefit of the 21 May 2013 filing date of U.S. provisional patent application No. 61/825,637, which is incorporated by reference herein.

FIELD OF THE INVENTION

The present invention relates to a profile for an airfoil of a gas turbine engine blade.

BACKGROUND OF THE INVENTION

An overall efficiency of gas turbine engines utilizing rotating blades to extract energy from a flow of working fluid is greatly influenced by the exact shape of the blades airfoil. The exact shape of the airfoils determines an overall efficiency for the engine. Each airfoil's aerodynamic efficiency can be quantitatively analyzed using aerodynamic parameters such as an airfoil section pressure loss, suction surface diffusion, suction side leading edge overspeed, and pressure side leading edge overspeed etc. However, the aerodynamic environment within each stage of the engine varies, and thus it is unlikely that a single airfoil design will be the most efficient in every stage. Similarly, there is rarely a single airfoil profile that yields the most efficient rating for all of the aerodynamic parameters. As a result, airfoils may be specifically designed to meet the aerodynamic needs of the stage in which it operates. Once the aerodynamic needs of the selected stage are defined, a final airfoil design for the selected stage usually involves striking a balance between the aerodynamic parameters.

Often, however, the resulting balance may work best for one intended application, but subsequently the design may be implemented in other applications that have different parameters that affect aerodynamics, and hence the original design may not be optimal. In addition, knowledge of those in the art may improve over time, allowing for innovative design changes that improve aerodynamic efficiency within the intended application. For these, and any number of other reasons, there exists an ongoing need in the art to produce blades with airfoils having improved aerodynamic efficiency.

BRIEF DESCRIPTION OF THE DRAWINGS

The invention is explained in the following description in view of the drawings that show.

DETAILED DESCRIPTION OF THE INVENTION

Figure 1:
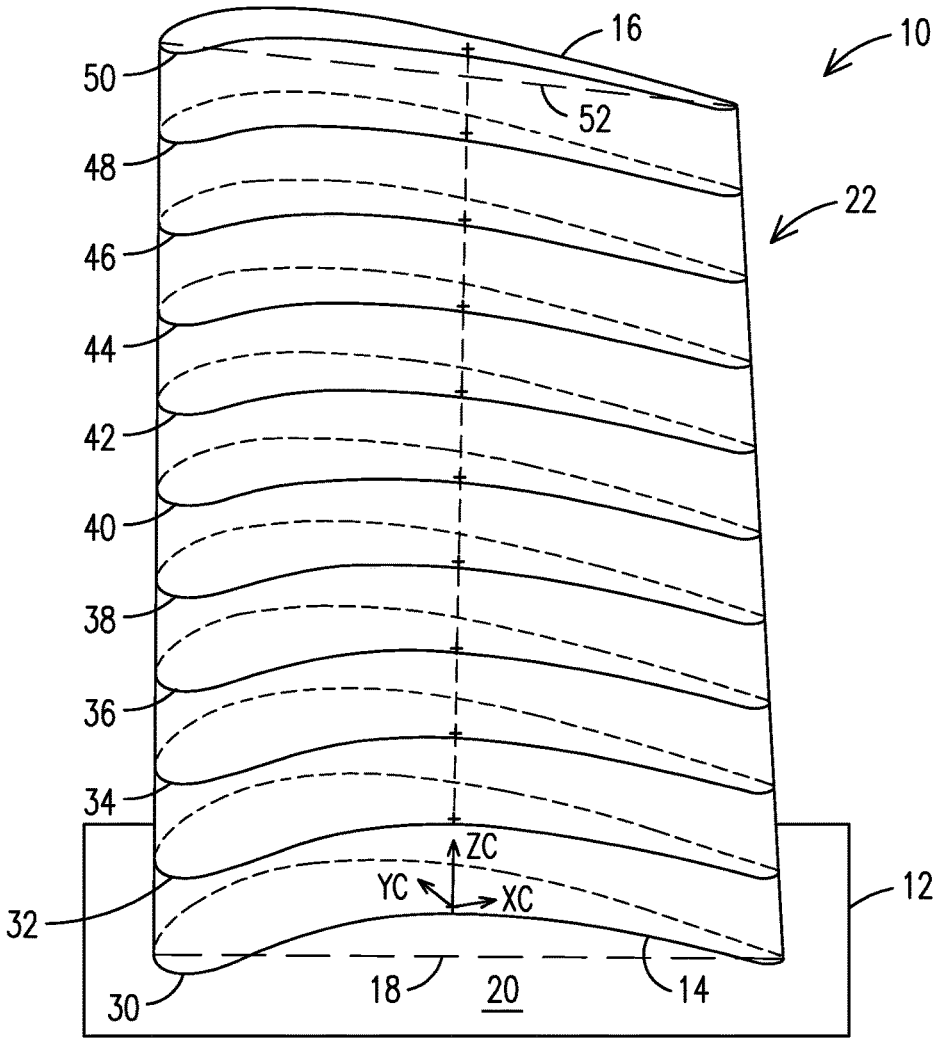
FIG. 1 shows the inventive airfoil in a three-dimensional view.

An aerodynamically efficient airfoil substrate 10 disposed on an inner platform 12 is shown three dimensionally in FIG. 1, which shows nominal cross-sectional profiles at various radial locations between a base 14 and a tip 16 of the airfoil substrate 10. A 0% mid chord 18 lies on an inner platform surface 20 and denotes a location of a nominal 0% radial profile 30, and further nominal radial profiles 32, 34, 36, 38, 40, 42, 44, 46, 48, and 50 are taken at 10%, 20%, 30%, 40%, 50%, 60%, 70%, 80%, 90%, and 100% intervals respectively, with the 100% nominal radial being located at a blade tip mid chord 42. Each nominal radial profile defines a respective mid chord (not shown). The airfoil substrate 10 may be used in a blade 22, such as a turbine blade for a gas turbine engine.

Nominal radial profiles 30, 32, 34, 36, 38, 40, 42, 44, 46, 48, and 50 are substantially characterized by nominal Cartesian coordinates X and Y presented in tables 1-11 respectively. Each nominal profile is fully characterized by smooth, continuing curves that connect the nominal X and Y coordinates to form a smooth, continuous airfoil shape. An exterior surface of the airfoil is a smooth, continuing surface between the nominal profiles. The nominal X and Y coordinates are presented as unitless dimensions at ambient temperature, as opposed to operating temperature. In one embodiment the nominal X and Y coordinates represent inches. When the nominal coordinates represent inches, the airfoil substrate 10 may be suitable for use as part of a first stage turbine blade. However, the absolute value of the nominal X and Y coordinates may vary so long as the relative values are retained. In other words, the airfoil profile can be scaled up or down as desired. The coordinates provided below are for a baseline configuration. The nominal X and Y coordinates do not include any coating thickness, such as an MCrAlY, and/or TBC coating, but instead represent a substrate, such as a casting. The term "nominal" as used herein is meant to mean a design goal. As such, there is a manufacturing tolerance associated with casting the actual radial profiles manufactured to these nominal X and Y coordinates. An acceptable manufacturing tolerance for the cast substrate (only) is +/−0.015 inches in a direction normal to the exterior surface at that location.

TABLE 1

| 0% Radial Span | |
|---|---|
| X units. (Axial) | Y units. (Circum.) |
| −2.367181 | −0.729001 |
| −2.428196 | −0.656235 |
| −2.441473 | −0.516103 * |
| −2.423718 | −0.423569 |
| −2.377882 | −0.289879 |
| −2.339658 | −0.203740 |
| −2.296963 | −0.119711 |
| −2.226169 | 0.002658 |
| −2.175161 | 0.081918 |
| −2.093669 | 0.197439 |
| −2.036396 | 0.272296 |
| −1.946549 | 0.381448 |
| −1.884052 | 0.452002 |

TABLE 1-continued

| 0% Radial Span | |
|---|---|
| X units. (Axial) | Y units. (Circum.) |
| −1.786380 | 0.554211 |
| −1.718637 | 0.619745 |
| −1.648771 | 0.683010 |
| −1.539957 | 0.773263 |
| −1.464736 | 0.830057 |
| −1.347881 | 0.909621 |
| −1.267294 | 0.958508 |
| −1.184590 | 1.003720 |
| −1.056681 | 1.063919 |
| −0.924393 | 1.113751 |
| −0.834000 | 1.140471 |
| −0.742108 | 1.161464 |
| −0.602132 | 1.181165 |
| −0.507976 | 1.185664 |
| −0.366829 | 1.178167 |
| −0.273706 | 1.163541 |
| −0.182057 | 1.141492 |
| −0.048579 | 1.094981 |
| 0.037021 | 1.055508 |
| 0.159568 | 0.985054 |
| 0.237084 | 0.931426 |
| 0.311119 | 0.873085 |
| 0.415717 | 0.777990 |
| 0.512987 | 0.675404 |
| 0.574081 | 0.603631 |
| 0.632399 | 0.529585 |
| 0.715136 | 0.414951 |
| 0.767487 | 0.336574 |
| 0.842321 | 0.216628 |
| 0.889968 | 0.135306 |
| 0.936007 | 0.053063 |
| 1.002414 | −0.071747 |
| 1.045165 | −0.155746 |
| 1.107446 | −0.282666 |
| 1.147970 | −0.367761 |
| 1.207371 | −0.496054 |
| 1.246035 | −0.582011 |
| 1.302598 | −0.711580 |
| 1.339300 | −0.798392 |
| 1.375130 | −0.885568 |
| 1.427115 | −1.017041 |
| 1.460683 | −1.105113 |
| 1.510203 | −1.237534 |
| 1.543351 | −1.325765 |
| 1.577032 | −1.413791 |
| 1.627533 | −1.545843 |
| 1.657943 | −1.635055 |
| 1.672590 | −1.679848 |
| 1.680575 | −1.702018 |
| 1.689020 | −1.724016 |
| 1.701642 | −1.757029 |
| 1.713134 | −1.790453 |
| 1.718911 | −1.813303 |
| 1.720261 | −1.848578 |
| 1.714683 | −1.871506 |
| 1.696747 | −1.901905 |
| 1.679761 | −1.918270 |
| 1.648738 | −1.935100 |
| 1.625650 | −1.939977 |
| 1.590424 | −1.937595 |
| 1.568141 | −1.929829 |
| 1.539666 | −1.908992 |
| 1.524700 | −1.890774 |
| 1.506264 | −1.860624 |
| 1.494915 | −1.839974 |
| 1.477780 | −1.809062 |
| 1.460344 | −1.778317 |
| 1.436517 | −1.737658 |
| 1.387321 | −1.657262 |
| 1.337247 | −1.577413 |
| 1.262275 | −1.457551 |
| 1.212711 | −1.377384 |
| 1.162428 | −1.297664 |
| 1.083002 | −1.180711 |
| 1.027000 | −1.104899 |
| 0.939187 | −0.994102 |

TABLE 1-continued

| 0% Radial Span | |
|---|---|
| X units. (Axial) | Y units. (Circum.) |
| 0.879029 | −0.921546 |
| 0.786454 | −0.814695 |
| 0.722851 | −0.745137 |
| 0.624098 | −0.643971 |
| 0.555763 | −0.579055 |
| 0.485250 | −0.516511 |
| 0.375133 | −0.427855 |
| 0.298699 | −0.372702 |
| 0.179372 | −0.296903 |
| 0.096688 | −0.251648 |
| 0.011565 | −0.211168 |
| −0.120335 | −0.160324 |
| −0.256573 | −0.122636 |
| −0.349266 | −0.105507 |
| −0.442927 | −0.094890 |
| −0.584231 | −0.091023 |
| −0.678337 | −0.096411 |
| −0.818346 | −0.115911 |
| −0.910473 | −0.135837 |
| −1.001382 | −0.160738 |
| −1.135176 | −0.206388 |
| −1.222579 | −0.241670 |
| −1.351012 | −0.300754 |
| −1.434944 | −0.343639 |
| −1.517688 | −0.388773 |
| −1.640054 | −0.459581 |
| −1.761113 | −0.532606 |
| −1.841790 | −0.581332 |
| −1.923202 | −0.628815 |
| −2.048993 | −0.693294 |
| −2.136811 | −0.727537 |
| −2.275705 | −0.753117 |

TABLE 2

| 10% Radial Span | |
|---|---|
| X units. (Axial) | Y units. (Circum.) |
| −2.361425 | −0.493438 |
| −2.385167 | −0.404412 |
| −2.371434 | −0.267193 |
| −2.344279 | −0.179303 |
| −2.289515 | −0.052713 |
| −2.246623 | 0.028642 |
| −2.199992 | 0.107911 |
| −2.124579 | 0.223413 |
| −2.043552 | 0.335049 |
| −1.986693 | 0.407331 |
| −1.927734 | 0.477911 |
| −1.835442 | 0.580432 |
| −1.771311 | 0.646348 |
| −1.671169 | 0.741213 |
| −1.601752 | 0.801539 |
| −1.530181 | 0.859293 |
| −1.418764 | 0.940616 |
| −1.341778 | 0.990927 |
| −1.222146 | 1.059590 |
| −1.139613 | 1.100171 |
| −1.054922 | 1.136030 |
| −0.924125 | 1.179806 |
| −0.789495 | 1.209756 |
| −0.698209 | 1.221007 |
| −0.606312 | 1.224837 |
| −0.468649 | 1.216486 |
| −0.377921 | 1.201374 |
| −0.245025 | 1.164502 |
| −0.159299 | 1.131179 |
| −0.076319 | 1.091511 |
| 0.042354 | 1.021226 |
| 0.117364 | 0.968006 |
| 0.223635 | 0.880076 |
| 0.290383 | 0.816806 |

TABLE 2-continued

| 10% Radial Span | |
|---|---|
| X units. (Axial) | Y units. (Circum.) |
| 0.353992 | 0.750382 |
| 0.444008 | 0.645863 |
| 0.528388 | 0.536739 |
| 0.582005 | 0.462020 |
| 0.633835 | 0.386051 |
| 0.708763 | 0.270229 |
| 0.757118 | 0.192004 |
| 0.827475 | 0.073349 |
| 0.873007 | −0.006553 |
| 0.917507 | −0.087035 |
| 0.982473 | −0.208725 |
| 1.024714 | −0.290414 |
| 1.086676 | −0.413661 |
| 1.127144 | −0.496243 |
| 1.166975 | −0.579135 |
| 1.225583 | −0.704012 |
| 1.282931 | −0.829473 |
| 1.320560 | −0.913386 |
| 1.357786 | −0.997480 |
| 1.412962 | −1.123911 |
| 1.449071 | −1.208490 |
| 1.501397 | −1.336125 |
| 1.534436 | −1.421951 |
| 1.565917 | −1.508361 |
| 1.596125 | −1.595224 |
| 1.619813 | −1.660001 |
| 1.628061 | −1.681461 |
| 1.636359 | −1.702903 |
| 1.648666 | −1.735118 |
| 1.659870 | −1.767733 |
| 1.665594 | −1.790004 |
| 1.667214 | −1.824413 |
| 1.657224 | −1.857399 |
| 1.644940 | −1.876851 |
| 1.628632 | −1.893114 |
| 1.598258 | −1.909338 |
| 1.564271 | −1.914963 |
| 1.541370 | −1.912643 |
| 1.509389 | −1.899861 |
| 1.483702 | −1.876888 |
| 1.470269 | −1.858229 |
| 1.458338 | −1.838573 |
| 1.441911 | −1.808252 |
| 1.425581 | −1.777876 |
| 1.413953 | −1.758042 |
| 1.377338 | −1.699590 |
| 1.329949 | −1.620767 |
| 1.283030 | −1.541676 |
| 1.235625 | −1.462871 |
| 1.162868 | −1.345672 |
| 1.112993 | −1.268406 |
| 1.035767 | −1.154104 |
| 0.982651 | −1.079029 |
| 0.900669 | −0.968089 |
| 0.844533 | −0.895244 |
| 0.787183 | −0.823352 |
| 0.698631 | −0.717581 |
| 0.637755 | −0.648649 |
| 0.543381 | −0.548041 |
| 0.478178 | −0.483184 |
| 0.410957 | −0.420423 |
| 0.306036 | −0.330873 |
| 0.233165 | −0.274767 |
| 0.119203 | −0.197057 |
| 0.040053 | −0.150219 |
| −0.083378 | −0.088660 |
| −0.168665 | −0.054233 |
| −0.300597 | −0.014028 |
| −0.390697 | 0.004453 |
| −0.481939 | 0.016034 |
| −0.619801 | 0.019993 |
| −0.711548 | 0.013504 |
| −0.847663 | −0.008765 |
| −0.936906 | −0.031001 |
| −1.024692 | −0.058427 |
| −1.153508 | −0.107751 |

TABLE 2-continued

| 10% Radial Span | |
|---|---|
| X units. (Axial) | Y units. (Circum.) |
| −1.237620 | −0.144940 |
| −1.361662 | −0.205291 |
| −1.443358 | −0.247519 |
| −1.565257 | −0.312094 |
| −1.646625 | −0.354951 |
| −1.769703 | −0.417250 |
| −1.852858 | −0.456523 |
| −1.937164 | −0.493228 |
| −2.066240 | −0.541831 |
| −2.155231 | −0.564763 |
| −2.292010 | −0.554922 |
| −2.361425 | −0.493438 |

TABLE 3

| 20% Radial Span | |
|---|---|
| X units. (Axial) | Y units. (Circum.) |
| −2.294107 | −0.344044 |
| −2.332146 | −0.262431 |
| −2.332410 | −0.127935 |
| −2.312121 | −0.040471 |
| −2.263922 | 0.085207 |
| −2.223542 | 0.165378 |
| −2.178667 | 0.243122 |
| −2.104888 | 0.355743 |
| −2.052083 | 0.428333 |
| −1.968036 | 0.533516 |
| −1.909098 | 0.601221 |
| −1.816656 | 0.699108 |
| −1.752315 | 0.761701 |
| −1.651695 | 0.851160 |
| −1.581847 | 0.907542 |
| −1.509698 | 0.960949 |
| −1.397040 | 1.034667 |
| −1.318968 | 1.078971 |
| −1.197588 | 1.137212 |
| −1.114016 | 1.169987 |
| −1.028540 | 1.197414 |
| −0.897322 | 1.227497 |
| −0.808339 | 1.239375 |
| −0.673789 | 1.243439 |
| −0.584289 | 1.236406 |
| −0.451920 | 1.211917 |
| −0.365711 | 1.186874 |
| −0.240598 | 1.137184 |
| −0.160485 | 1.096681 |
| −0.083271 | 1.050892 |
| 0.026781 | 0.973347 |
| 0.096243 | 0.916486 |
| 0.194829 | 0.824797 |
| 0.257065 | 0.760110 |
| 0.316737 | 0.693051 |
| 0.401825 | 0.588707 |
| 0.455900 | 0.517060 |
| 0.533607 | 0.407106 |
| 0.583482 | 0.332474 |
| 0.632084 | 0.257008 |
| 0.703095 | 0.142614 |
| 0.772196 | 0.027055 |
| 0.817268 | −0.050571 |
| 0.861586 | −0.128630 |
| 0.926733 | −0.246463 |
| 0.969340 | −0.325468 |
| 1.032124 | −0.444577 |
| 1.073278 | −0.524349 |
| 1.113864 | −0.604412 |
| 1.173646 | −0.725056 |
| 1.212748 | −0.805854 |
| 1.270252 | −0.927600 |
| 1.307816 | −1.009124 |
| 1.344759 | −1.090931 |

TABLE 3-continued

| 20% Radial Span | |
|---|---|
| X units. (Axial) | Y units. (Circum.) |
| 1.398928 | −1.214197 |
| 1.434083 | −1.296789 |
| 1.485064 | −1.421407 |
| 1.517645 | −1.505048 |
| 1.548900 | −1.589192 |
| 1.564428 | −1.631302 |
| 1.576266 | −1.662813 |
| 1.588188 | −1.694291 |
| 1.596000 | −1.715328 |
| 1.606697 | −1.747243 |
| 1.614490 | −1.779983 |
| 1.616474 | −1.802347 |
| 1.610721 | −1.835468 |
| 1.592944 | −1.864018 |
| 1.576279 | −1.879077 |
| 1.546124 | −1.893948 |
| 1.512730 | −1.897985 |
| 1.490486 | −1.894838 |
| 1.459764 | −1.881196 |
| 1.435494 | −1.857892 |
| 1.422951 | −1.839287 |
| 1.406681 | −1.809819 |
| 1.390360 | −1.780381 |
| 1.379254 | −1.760881 |
| 1.367988 | −1.741473 |
| 1.333696 | −1.683540 |
| 1.288030 | −1.606262 |
| 1.242336 | −1.529001 |
| 1.172997 | −1.413585 |
| 1.125914 | −1.337162 |
| 1.077898 | −1.261322 |
| 1.003785 | −1.148912 |
| 0.952931 | −1.074945 |
| 0.874686 | −0.965372 |
| 0.821310 | −0.893203 |
| 0.766980 | −0.821750 |
| 0.683427 | −0.716169 |
| 0.626159 | −0.647048 |
| 0.537588 | −0.545640 |
| 0.476550 | −0.479824 |
| 0.413753 | −0.415683 |
| 0.315989 | −0.323109 |
| 0.248227 | −0.264238 |
| 0.142319 | −0.181110 |
| 0.068707 | −0.129737 |
| −0.046377 | −0.059871 |
| −0.126227 | −0.018854 |
| −0.250510 | 0.032885 |
| −0.336081 | 0.060027 |
| −0.423421 | 0.080778 |
| −0.556807 | 0.098925 |
| −0.646538 | 0.101737 |
| −0.780851 | 0.092653 |
| −0.869540 | 0.078771 |
| −0.957197 | 0.059414 |
| −1.086402 | 0.021573 |
| −1.171005 | −0.008430 |
| −1.295892 | −0.058738 |
| −1.378098 | −0.094786 |
| −1.500463 | −0.150962 |
| −1.581828 | −0.188868 |
| −1.704296 | −0.244819 |
| −1.786603 | −0.280634 |
| −1.869704 | −0.314552 |
| −1.996061 | −0.361014 |
| −2.082191 | −0.386186 |
| −2.216309 | −0.389958 |
| −2.294107 | −0.344044 |

TABLE 4

| 30% Radial Span | |
|---|---|
| X units. (Axial) | Y units. (Circum.) |
| −2.226470 | −0.200261 |
| −2.276949 | −0.128125 |
| −2.293628 | 0.001985 |
| −2.280842 | 0.088738 |
| −2.241361 | 0.214119 |
| −2.205158 | 0.293969 |
| −2.163010 | 0.370851 |
| −2.091225 | 0.481017 |
| −2.038937 | 0.551390 |
| −1.954882 | 0.652512 |
| −1.895517 | 0.717026 |
| −1.801935 | 0.809404 |
| −1.736520 | 0.867776 |
| −1.633824 | 0.949899 |
| −1.562319 | 1.000628 |
| −1.488370 | 1.047726 |
| −1.372910 | 1.110640 |
| −1.293025 | 1.146770 |
| −1.169269 | 1.191181 |
| −1.084528 | 1.213683 |
| −0.998395 | 1.230070 |
| −0.867510 | 1.242547 |
| −0.779832 | 1.242559 |
| −0.648995 | 1.229625 |
| −0.563070 | 1.212168 |
| −0.478766 | 1.188078 |
| −0.356112 | 1.140713 |
| −0.277261 | 1.102377 |
| −0.163810 | 1.035909 |
| −0.091517 | 0.986308 |
| 0.011871 | 0.905060 |
| 0.077495 | 0.846924 |
| 0.171273 | 0.754744 |
| 0.230923 | 0.690495 |
| 0.288485 | 0.624369 |
| 0.371178 | 0.522124 |
| 0.424058 | 0.452198 |
| 0.500364 | 0.345100 |
| 0.549458 | 0.272466 |
| 0.597331 | 0.199023 |
| 0.667261 | 0.087655 |
| 0.712824 | 0.012757 |
| 0.779711 | −0.100464 |
| 0.823392 | −0.176476 |
| 0.866396 | −0.252873 |
| 0.929724 | −0.368123 |
| 0.991769 | −0.484068 |
| 1.032482 | −0.561710 |
| 1.072666 | −0.639627 |
| 1.131897 | −0.757035 |
| 1.170652 | −0.835672 |
| 1.227617 | −0.954196 |
| 1.264770 | −1.033603 |
| 1.301228 | −1.113331 |
| 1.354574 | −1.233528 |
| 1.389265 | −1.314041 |
| 1.440072 | −1.435332 |
| 1.473119 | −1.516534 |
| 1.505045 | −1.598185 |
| 1.520341 | −1.639263 |
| 1.527977 | −1.659807 |
| 1.540024 | −1.690395 |
| 1.552493 | −1.720815 |
| 1.560213 | −1.741323 |
| 1.570699 | −1.783839 |
| 1.571541 | −1.805771 |
| 1.564541 | −1.837861 |
| 1.546877 | −1.865550 |
| 1.530159 | −1.879787 |
| 1.500333 | −1.893574 |
| 1.467661 | −1.896999 |
| 1.446059 | −1.893089 |
| 1.416610 | −1.878523 |
| 1.393574 | −1.855113 |
| 1.381793 | −1.836625 |
| 1.366007 | −1.807787 |

TABLE 4-continued

| 30% Radial Span | |
|---|---|
| X units. (Axial) | Y units. (Circum.) |
| 1.350192 | −1.778965 |
| 1.339220 | −1.759992 |
| 1.316891 | −1.722271 |
| 1.294900 | −1.684351 |
| 1.251420 | −1.608226 |
| 1.207041 | −1.532618 |
| 1.139435 | −1.419825 |
| 1.093663 | −1.345053 |
| 1.047176 | −1.270725 |
| 0.975747 | −1.160313 |
| 0.926858 | −1.087542 |
| 0.851700 | −0.979634 |
| 0.800459 | −0.908499 |
| 0.748354 | −0.837994 |
| 0.668370 | −0.733614 |
| 0.613649 | −0.665119 |
| 0.529179 | −0.564336 |
| 0.471099 | −0.498665 |
| 0.381050 | −0.402834 |
| 0.318919 | −0.340982 |
| 0.222275 | −0.251810 |
| 0.155338 | −0.195191 |
| 0.086259 | −0.141206 |
| −0.021564 | −0.065940 |
| −0.096340 | −0.020169 |
| −0.212873 | 0.040737 |
| −0.293374 | 0.075473 |
| −0.375935 | 0.104979 |
| −0.503108 | 0.138359 |
| −0.589625 | 0.152587 |
| −0.720795 | 0.161611 |
| −0.808455 | 0.159971 |
| −0.895829 | 0.152689 |
| −1.025703 | 0.132150 |
| −1.111236 | 0.112896 |
| −1.237785 | 0.077169 |
| −1.321014 | 0.049618 |
| −1.444418 | 0.004189 |
| −1.525980 | −0.027959 |
| −1.647765 | −0.077573 |
| −1.728781 | −0.111069 |
| −1.809738 | −0.144697 |
| −1.931590 | −0.194123 |
| −2.014686 | −0.222026 |
| −2.145264 | −0.234460 |
| −2.226470 | −0.200261 |

TABLE 5

| 40% Radial Span | |
|---|---|
| X units. (Axial) | Y units. (Circum.) |
| −2.158075 | −0.068515 |
| −2.218765 | −0.007426 |
| −2.251982 | 0.116235 |
| −2.246535 | 0.201784 |
| −2.214549 | 0.326213 |
| −2.182567 | 0.405712 |
| −2.143289 | 0.481884 |
| −2.073402 | 0.589732 |
| −2.021493 | 0.657915 |
| −1.937204 | 0.754937 |
| −1.877230 | 0.816144 |
| −1.814501 | 0.874524 |
| −1.715342 | 0.956290 |
| −1.610124 | 1.030092 |
| −1.536695 | 1.074271 |
| −1.460777 | 1.114022 |
| −1.342615 | 1.164560 |
| −1.261307 | 1.191630 |
| −1.136272 | 1.221316 |
| −1.051407 | 1.233245 |

TABLE 5-continued

| 40% Radial Span | |
|---|---|
| X units. (Axial) | Y units. (Circum.) |
| −0.965869 | 1.238522 |
| −0.837454 | 1.233671 |
| −0.752508 | 1.222345 |
| −0.627142 | 1.194084 |
| −0.545493 | 1.168058 |
| −0.465743 | 1.136693 |
| −0.350099 | 1.080627 |
| −0.275844 | 1.037851 |
| −0.168878 | 0.966602 |
| −0.100476 | 0.914986 |
| −0.034310 | 0.860532 |
| 0.060976 | 0.774278 |
| 0.121974 | 0.714094 |
| 0.209886 | 0.620332 |
| 0.266247 | 0.555785 |
| 0.347627 | 0.456300 |
| 0.399896 | 0.388397 |
| 0.475550 | 0.284490 |
| 0.524304 | 0.214022 |
| 0.571839 | 0.142726 |
| 0.641107 | 0.034455 |
| 0.686081 | −0.038483 |
| 0.751881 | −0.148896 |
| 0.794717 | −0.223110 |
| 0.836791 | −0.297758 |
| 0.898592 | −0.410459 |
| 0.939000 | −0.486022 |
| 0.998562 | −0.599922 |
| 1.037608 | −0.676198 |
| 1.076120 | −0.752744 |
| 1.132879 | −0.868066 |
| 1.170037 | −0.945279 |
| 1.224737 | −1.061592 |
| 1.260503 | −1.139460 |
| 1.313085 | −1.256746 |
| 1.347412 | −1.335258 |
| 1.397786 | −1.453509 |
| 1.430607 | −1.532663 |
| 1.454750 | −1.592224 |
| 1.478113 | −1.652093 |
| 1.485729 | −1.672116 |
| 1.493334 | −1.692143 |
| 1.509134 | −1.731967 |
| 1.516739 | −1.751995 |
| 1.525429 | −1.782927 |
| 1.527581 | −1.814971 |
| 1.523444 | −1.836044 |
| 1.508255 | −1.864327 |
| 1.484559 | −1.886004 |
| 1.455024 | −1.898612 |
| 1.422977 | −1.900709 |
| 1.402032 | −1.895986 |
| 1.374044 | −1.880253 |
| 1.352156 | −1.856749 |
| 1.340888 | −1.838522 |
| 1.320825 | −1.800666 |
| 1.310111 | −1.782111 |
| 1.293933 | −1.754348 |
| 1.277812 | −1.726550 |
| 1.256473 | −1.689399 |
| 1.214013 | −1.614969 |
| 1.170947 | −1.540888 |
| 1.105095 | −1.430506 |
| 1.060361 | −1.357420 |
| 1.014918 | −1.284774 |
| 0.945325 | −1.176711 |
| 0.897919 | −1.105330 |
| 0.825239 | −0.999319 |
| 0.775719 | −0.929388 |
| 0.725328 | −0.860081 |
| 0.647964 | −0.757439 |
| 0.568209 | −0.656644 |
| 0.513571 | −0.590634 |
| 0.457657 | −0.525700 |
| 0.371203 | −0.430590 |
| 0.311729 | −0.368900 |

TABLE 5-continued

| 40% Radial Span | |
|---|---|
| X units. (Axial) | Y units. (Circum.) |
| 0.219548 | −0.279331 |
| 0.155962 | −0.221889 |
| 0.090560 | −0.166522 |
| −0.011108 | −0.087891 |
| −0.081372 | −0.038839 |
| −0.190616 | 0.028869 |
| −0.266019 | 0.069583 |
| −0.343433 | 0.106332 |
| −0.463119 | 0.153155 |
| −0.545070 | 0.178211 |
| −0.670593 | 0.205784 |
| −0.755496 | 0.217409 |
| −0.840969 | 0.223602 |
| −0.969482 | 0.222733 |
| −1.097426 | 0.210571 |
| −1.182007 | 0.196814 |
| −1.265821 | 0.178968 |
| −1.389954 | 0.145647 |
| −1.471687 | 0.119908 |
| −1.592962 | 0.077335 |
| −1.672926 | 0.046535 |
| −1.751961 | 0.013418 |
| −1.868821 | −0.040095 |
| −1.948457 | −0.071734 |
| −2.075224 | −0.091510 |
| −2.158075 | −0.068515 |

TABLE 6

| 50% Radial Span | |
|---|---|
| X units. (Axial) | Y units. (Circum.) |
| −2.167364 | 0.108075 |
| −2.200626 | 0.185198 |
| −2.203616 | 0.310640 * |
| −2.185205 | 0.392401 |
| −2.140247 | 0.509712 |
| −2.100889 | 0.583688 |
| −2.055265 | 0.653967 |
| −1.978161 | 0.753186 |
| −1.922084 | 0.815438 |
| −1.831778 | 0.902816 |
| −1.767780 | 0.956893 |
| −1.700910 | 1.007374 |
| −1.595347 | 1.075533 |
| −1.483793 | 1.133363 |
| −1.406426 | 1.165532 |
| −1.327020 | 1.192274 |
| −1.204836 | 1.221576 |
| −1.121897 | 1.233488 |
| −0.996391 | 1.239425 |
| −0.912706 | 1.235221 |
| −0.829615 | 1.224411 |
| −0.707107 | 1.196493 |
| −0.627310 | 1.170946 |
| −0.510955 | 1.123499 |
| −0.435827 | 1.086410 |
| −0.362765 | 1.045399 |
| −0.257146 | 0.977315 |
| −0.189388 | 0.928035 |
| −0.091636 | 0.849066 |
| −0.028945 | 0.793484 |
| 0.031883 | 0.735870 |
| 0.119822 | 0.646098 |
| 0.176342 | 0.584253 |
| 0.258152 | 0.488861 |
| 0.310826 | 0.423709 |
| 0.362094 | 0.357445 |
| 0.436533 | 0.256195 |
| 0.508263 | 0.153008 |
| 0.554695 | 0.083270 |
| 0.600096 | 0.012857 |

TABLE 6-continued

| 50% Radial Span | |
|---|---|
| X units. (Axial) | Y units. (Circum.) |
| 0.666408 | −0.093893 |
| 0.709502 | −0.165741 |
| 0.772581 | −0.274433 |
| 0.813661 | −0.347451 |
| 0.854018 | −0.420871 |
| 0.913308 | −0.531677 |
| 0.952075 | −0.605948 |
| 1.009195 | −0.717887 |
| 1.046610 | −0.792850 |
| 1.083502 | −0.868070 |
| 1.137886 | −0.981364 |
| 1.173520 | −1.057189 |
| 1.226068 | −1.171346 |
| 1.260515 | −1.247717 |
| 1.294491 | −1.324299 |
| 1.344548 | −1.439570 |
| 1.377285 | −1.516689 |
| 1.409438 | −1.594056 |
| 1.429012 | −1.642622 |
| 1.440918 | −1.671697 |
| 1.449092 | −1.690981 |
| 1.465810 | −1.729392 |
| 1.473410 | −1.748912 |
| 1.482573 | −1.789737 |
| 1.483092 | −1.810697 |
| 1.476929 | −1.841487 |
| 1.460652 | −1.868322 |
| 1.444787 | −1.882070 |
| 1.406011 | −1.897506 |
| 1.385034 | −1.898310 |
| 1.355000 | −1.889243 |
| 1.329690 | −1.870647 |
| 1.315473 | −1.855259 |
| 1.297277 | −1.829652 |
| 1.281712 | −1.802361 |
| 1.266631 | −1.774801 |
| 1.250549 | −1.747809 |
| 1.239843 | −1.729808 |
| 1.208251 | −1.675490 |
| 1.166185 | −1.603039 |
| 1.123769 | −1.530788 |
| 1.080822 | −1.458852 |
| 1.015085 | −1.351746 |
| 0.970339 | −1.280916 |
| 0.924861 | −1.210552 |
| 0.855325 | −1.105873 |
| 0.784187 | −1.002276 |
| 0.735837 | −0.933855 |
| 0.686719 | −0.865982 |
| 0.611485 | −0.765320 |
| 0.560177 | −0.699088 |
| 0.481296 | −0.601259 |
| 0.427324 | −0.537178 |
| 0.372163 | −0.474118 |
| 0.287053 | −0.381658 |
| 0.228644 | −0.321594 |
| 0.138344 | −0.234196 |
| 0.076250 | −0.177950 |
| 0.012568 | −0.123507 |
| −0.086105 | −0.045689 |
| −0.154115 | 0.003241 |
| −0.259623 | 0.071501 |
| −0.332324 | 0.113147 |
| −0.406896 | 0.151341 |
| −0.522143 | 0.201425 |
| −0.601075 | 0.229526 |
| −0.722150 | 0.263152 |
| −0.804320 | 0.279530 |
| −0.929101 | 0.294312 |
| −1.012825 | 0.297554 |
| −1.138392 | 0.292808 |
| −1.221660 | 0.283508 |
| −1.304294 | 0.269671 |
| −1.426771 | 0.241556 |
| −1.507367 | 0.218670 |
| −1.626553 | 0.178834 |

TABLE 6-continued

| 50% Radial Span | |
|---|---|
| X units. (Axial) | Y units. (Circum.) |
| −1.704463 | 0.148022 |
| −1.780713 | 0.113346 |
| −1.895783 | 0.062863 |
| −1.977030 | 0.042311 |
| −2.101341 | 0.055677 |
| −2.167364 | 0.108075 |

TABLE 7

| 60% Radial Span | |
|---|---|
| X units. (Axial) | Y units. (Circum.) |
| −2.101700 | 0.198219 |
| −2.146660 | 0.267190 |
| −2.156320 | 0.389474 |
| −2.138673 | 0.469575 |
| −2.091881 | 0.583268 |
| −2.051553 | 0.654663 |
| −2.005442 | 0.722476 |
| −1.927982 | 0.817997 |
| −1.871864 | 0.877789 |
| −1.781408 | 0.961107 |
| −1.717107 | 1.011997 |
| −1.649788 | 1.058822 |
| −1.543475 | 1.120636 |
| −1.469307 | 1.155621 |
| −1.353744 | 1.197660 |
| −1.274388 | 1.218338 |
| −1.193698 | 1.232972 |
| −1.071158 | 1.243257 |
| −0.948247 | 1.239396 |
| −0.866887 | 1.229127 |
| −0.786518 | 1.212826 |
| −0.668721 | 1.177515 |
| −0.592411 | 1.147497 |
| −0.481581 | 1.094188 |
| −0.410184 | 1.053861 |
| −0.340816 | 1.010133 |
| −0.240611 | 0.938824 |
| −0.176353 | 0.887884 |
| −0.083703 | 0.806999 |
| −0.024349 | 0.750424 |
| 0.033164 | 0.691977 |
| 0.116180 | 0.601228 |
| 0.169505 | 0.538938 |
| 0.246747 | 0.443225 |
| 0.296582 | 0.378109 |
| 0.345206 | 0.312085 |
| 0.416085 | 0.211567 |
| 0.462115 | 0.143709 |
| 0.529516 | 0.040827 |
| 0.573413 | −0.028431 |
| 0.616525 | −0.098179 |
| 0.679803 | −0.203648 |
| 0.721097 | −0.274487 |
| 0.781760 | −0.381482 |
| 0.821383 | −0.453269 |
| 0.860379 | −0.525400 |
| 0.917751 | −0.634194 |
| 0.973848 | −0.743651 |
| 1.010570 | −0.816965 |
| 1.046767 | −0.890540 |
| 1.100106 | −1.001368 |
| 1.135048 | −1.075547 |
| 1.186572 | −1.187230 |
| 1.220348 | −1.261947 |
| 1.253684 | −1.336861 |
| 1.302913 | −1.449575 |
| 1.335249 | −1.524926 |
| 1.367230 | −1.600429 |
| 1.383118 | −1.638224 |
| 1.395017 | −1.666577 |

TABLE 7-continued

| 60% Radial Span | |
|---|---|
| X units. (Axial) | Y units. (Circum.) |
| 1.406879 | −1.694946 |
| 1.418647 | −1.723354 |
| 1.429992 | −1.751929 |
| 1.436648 | −1.771308 |
| 1.441912 | −1.811843 |
| 1.437960 | −1.832029 |
| 1.424342 | −1.859604 |
| 1.402071 | −1.880781 |
| 1.373687 | −1.892572 |
| 1.343016 | −1.894658 |
| 1.313218 | −1.887092 |
| 1.287829 | −1.869789 |
| 1.274867 | −1.853871 |
| 1.253784 | −1.818707 |
| 1.243749 | −1.800833 |
| 1.228226 | −1.774290 |
| 1.212435 | −1.747906 |
| 1.196585 | −1.721557 |
| 1.170217 | −1.677613 |
| 1.128156 | −1.607226 |
| 1.086017 | −1.536886 |
| 1.022096 | −1.431805 |
| 0.978751 | −1.362201 |
| 0.934759 | −1.293004 |
| 0.867597 | −1.189966 |
| 0.822055 | −1.121779 |
| 0.752589 | −1.020279 |
| 0.705492 | −0.953157 |
| 0.657750 | −0.886493 |
| 0.584879 | −0.787409 |
| 0.535382 | −0.722037 |
| 0.459610 | −0.625154 |
| 0.407992 | −0.561443 |
| 0.355416 | −0.498520 |
| 0.274615 | −0.405791 |
| 0.219368 | −0.345200 |
| 0.134259 | −0.256409 |
| 0.075918 | −0.198790 |
| 0.016214 | −0.142584 |
| −0.076056 | −0.061263 |
| −0.139540 | −0.009363 |
| −0.237973 | 0.064376 |
| −0.305838 | 0.110401 |
| −0.375534 | 0.153602 |
| −0.483503 | 0.212495 |
| −0.595459 | 0.263397 |
| −0.672148 | 0.292432 |
| −0.750308 | 0.317236 |
| −0.869957 | 0.345662 |
| −0.950987 | 0.358267 |
| −1.073627 | 0.367382 |
| −1.155629 | 0.366917 |
| −1.237441 | 0.361334 |
| −1.359215 | 0.344134 |
| −1.439492 | 0.327413 |
| −1.558240 | 0.295402 |
| −1.636027 | 0.269453 |
| −1.712384 | 0.239558 |
| −1.825619 | 0.191545 |
| −1.904087 | 0.167660 |
| −2.026807 | 0.164201 |
| −2.101700 | 0.198219 |

TABLE 8

| 70% Radial Span | |
|---|---|
| X units. (Axial) | Y units. (Circum.) |
| −2.095669 | 0.358727 |
| −2.109034 | 0.438006 |
| −2.084765 | 0.555751 |
| −2.051982 | 0.628992 |

TABLE 8-continued

| 70% Radial Span | |
|---|---|
| X units. (Axial) | Y units. (Circum.) |
| −1.989155 | 0.731586 |
| −1.940896 | 0.795672 |
| −1.888819 | 0.856696 |
| −1.804709 | 0.942732 |
| −1.744771 | 0.996055 |
| −1.648940 | 1.068799 |
| −1.581150 | 1.111705 |
| −1.510439 | 1.149606 |
| −1.399532 | 1.196225 |
| −1.322865 | 1.219871 |
| −1.204883 | 1.243384 |
| −1.125027 | 1.251117 |
| −1.044811 | 1.252592 |
| −0.924868 | 1.243245 |
| −0.845818 | 1.229549 |
| −0.729610 | 1.198400 |
| −0.654208 | 1.170998 |
| −0.544727 | 1.121099 |
| −0.474219 | 1.082832 |
| −0.372166 | 1.019094 |
| −0.306599 | 0.972872 |
| −0.243058 | 0.923900 |
| −0.151611 | 0.845700 |
| −0.093239 | 0.790671 |
| −0.009411 | 0.704351 |
| 0.044142 | 0.644623 |
| 0.095979 | 0.583399 |
| 0.170811 | 0.489170 |
| 0.218954 | 0.425002 |
| 0.288921 | 0.327107 |
| 0.334273 | 0.260937 |
| 0.378734 | 0.194164 |
| 0.444034 | 0.093095 |
| 0.486813 | 0.025233 |
| 0.549946 | −0.077204 |
| 0.591362 | −0.145906 |
| 0.632255 | −0.214921 |
| 0.692619 | −0.319014 |
| 0.732210 | −0.388784 |
| 0.790610 | −0.493991 |
| 0.828882 | −0.564493 |
| 0.866623 | −0.635281 |
| 0.922229 | −0.741991 |
| 0.958629 | −0.813478 |
| 1.012247 | −0.921201 |
| 1.047357 | −0.993329 |
| 1.081976 | −1.065695 |
| 1.133012 | −1.174665 |
| 1.166462 | −1.247578 |
| 1.215812 | −1.357323 |
| 1.248210 | −1.430709 |
| 1.296210 | −1.541051 |
| 1.312088 | −1.577884 |
| 1.335725 | −1.633212 |
| 1.347639 | −1.660834 |
| 1.359859 | −1.688323 |
| 1.372363 | −1.715684 |
| 1.384002 | −1.743423 |
| 1.393021 | −1.772122 |
| 1.396881 | −1.801949 |
| 1.394736 | −1.821936 |
| 1.377239 | −1.857825 |
| 1.362845 | −1.871852 |
| 1.336276 | −1.885971 |
| 1.306405 | −1.889384 |
| 1.277132 | −1.882484 |
| 1.251375 | −1.866950 |
| 1.230947 | −1.844870 |
| 1.214294 | −1.819819 |
| 1.199379 | −1.793694 |
| 1.184745 | −1.767411 |
| 1.169462 | −1.741500 |
| 1.153707 | −1.715874 |
| 1.122132 | −1.664660 |
| 1.101303 | −1.630382 |
| 1.038445 | −1.527775 |

TABLE 8-continued

| 70% Radial Span | |
|---|---|
| X units. (Axial) | Y units. (Circum.) |
| 0.996155 | −1.459608 |
| 0.931827 | −1.357917 |
| 0.888317 | −1.290521 |
| 0.844405 | −1.223387 |
| 0.777812 | −1.123164 |
| 0.732868 | −1.056717 |
| 0.664495 | −0.957700 |
| 0.618198 | −0.892188 |
| 0.571268 | −0.827128 |
| 0.499641 | −0.730439 |
| 0.451063 | −0.666600 |
| 0.376953 | −0.571800 |
| 0.326675 | −0.509292 |
| 0.275613 | −0.447422 |
| 0.197382 | −0.355994 |
| 0.144027 | −0.296090 |
| 0.061958 | −0.208092 |
| 0.005749 | −0.150856 |
| −0.051758 | −0.094926 |
| −0.140674 | −0.013854 |
| −0.233071 | 0.063225 |
| −0.296737 | 0.112032 |
| −0.362123 | 0.158510 |
| −0.463501 | 0.223318 |
| −0.533299 | 0.262867 |
| −0.641257 | 0.315987 |
| −0.715333 | 0.346790 |
| −0.790995 | 0.373461 |
| −0.907153 | 0.404810 |
| −0.986008 | 0.419581 |
| −1.105656 | 0.432211 |
| −1.185859 | 0.434151 |
| −1.266021 | 0.430956 |
| −1.385526 | 0.417008 |
| −1.464317 | 0.401909 |
| −1.580629 | 0.371109 |
| −1.656588 | 0.345307 |
| −1.731502 | 0.316715 |
| −1.846380 | 0.281016 |
| −1.925976 | 0.271308 |
| −2.042652 | 0.297671 |
| −2.095669 | 0.358727 |

TABLE 9

| 80% Radial Span | |
|---|---|
| X units. (Axial) | Y units. (Circum.) |
| −2.038721 | 0.436869 |
| −2.063604 | 0.511871 |
| −2.043408 | 0.628026 |
| −2.010108 | 0.699391 |
| −1.945043 | 0.797912 |
| −1.895585 | 0.859169 |
| −1.842841 | 0.917627 |
| −1.758272 | 1.000050 |
| −1.698290 | 1.051058 |
| −1.602556 | 1.120182 |
| −1.534800 | 1.160300 |
| −1.464039 | 1.194845 |
| −1.353157 | 1.235419 |
| −1.276754 | 1.254482 |
| −1.159748 | 1.270293 |
| −1.081034 | 1.272408 |
| −1.002408 | 1.268106 |
| −0.885697 | 1.250200 |
| −0.809327 | 1.231024 |
| −0.697803 | 1.192223 |
| −0.625836 | 1.160276 |
| −0.555949 | 1.124005 |
| −0.455004 | 1.062726 |
| −0.390216 | 1.017983 |

TABLE 9-continued

| 80% Radial Span | |
|---|---|
| X units. (Axial) | Y units. (Circum.) |
| −0.296684 | 0.945887 |
| −0.236774 | 0.894799 |
| −0.178853 | 0.841466 |
| −0.095751 | 0.757559 |
| −0.042814 | 0.699276 |
| 0.033195 | 0.608891 |
| 0.081820 | 0.546967 |
| 0.152075 | 0.452038 |
| 0.197335 | 0.387614 |
| 0.263238 | 0.289613 |
| 0.306069 | 0.223549 |
| 0.348181 | 0.157025 |
| 0.410303 | 0.056584 |
| 0.451218 | −0.010683 |
| 0.511989 | −0.111947 |
| 0.552091 | −0.179702 |
| 0.591853 | −0.247658 |
| 0.650834 | −0.349974 |
| 0.689691 | −0.418451 |
| 0.747239 | −0.521581 |
| 0.785089 | −0.590619 |
| 0.822506 | −0.659893 |
| 0.877783 | −0.764258 |
| 0.914045 | −0.834143 |
| 0.967543 | −0.939431 |
| 1.002623 | −1.009917 |
| 1.037244 | −1.080630 |
| 1.088329 | −1.187109 |
| 1.121835 | −1.258357 |
| 1.171288 | −1.365604 |
| 1.203750 | −1.437334 |
| 1.235904 | −1.509202 |
| 1.267861 | −1.581158 |
| 1.291802 | −1.635137 |
| 1.299790 | −1.653126 |
| 1.315914 | −1.689040 |
| 1.324164 | −1.706911 |
| 1.336806 | −1.733590 |
| 1.348162 | −1.760847 |
| 1.355016 | −1.789558 |
| 1.354128 | −1.819079 |
| 1.336906 | −1.854295 |
| 1.322547 | −1.867838 |
| 1.286863 | −1.884178 |
| 1.267238 | −1.886278 |
| 1.229175 | −1.876874 |
| 1.212699 | −1.866015 |
| 1.187042 | −1.836265 |
| 1.177575 | −1.819006 |
| 1.158599 | −1.784519 |
| 1.148018 | −1.767918 |
| 1.126793 | −1.734762 |
| 1.116316 | −1.718098 |
| 1.085274 | −1.667867 |
| 1.043820 | −1.600930 |
| 1.002236 | −1.534074 |
| 0.960270 | −1.467457 |
| 0.896518 | −1.368043 |
| 0.853519 | −1.302088 |
| 0.810226 | −1.236327 |
| 0.744865 | −1.137963 |
| 0.700937 | −1.072623 |
| 0.634329 | −0.975099 |
| 0.589337 | −0.910488 |
| 0.543787 | −0.846269 |
| 0.474315 | −0.750764 |
| 0.427257 | −0.687642 |
| 0.355614 | −0.593754 |
| 0.307166 | −0.531692 |
| 0.233330 | −0.439520 |
| 0.183225 | −0.378787 |
| 0.106567 | −0.288950 |
| 0.054327 | −0.230043 |
| 0.001062 | −0.172062 |
| −0.080969 | −0.087102 |
| −0.137207 | −0.032000 |

TABLE 9-continued

| 80% Radial Span | |
|---|---|
| X units. (Axial) | Y units. (Circum.) |
| −0.224090 | 0.047989 |
| −0.283793 | 0.099318 |
| −0.344991 | 0.148855 |
| −0.439738 | 0.219350 |
| −0.504947 | 0.263475 |
| −0.605912 | 0.324728 |
| −0.675376 | 0.361799 |
| −0.746582 | 0.395402 |
| −0.856558 | 0.438411 |
| −0.931788 | 0.461656 |
| −1.046938 | 0.487813 |
| −1.124865 | 0.499099 |
| −1.203369 | 0.505190 |
| −1.321444 | 0.504120 |
| −1.399796 | 0.496294 |
| −1.515653 | 0.473501 |
| −1.591219 | 0.451376 |
| −1.665667 | 0.425812 |
| −1.778728 | 0.391749 |
| −1.856575 | 0.379915 |
| −1.973868 | 0.391620 |
| −2.038721 | 0.436869 |

TABLE 10

| 90% Radial Span | |
|---|---|
| X units. (Axial) | Y units. (Circum.) |
| −1.983536 | 0.524357 |
| −2.022292 | 0.592046 |
| −2.011659 | 0.707224 |
| −1.980324 | 0.778051 |
| −1.915703 | 0.874579 |
| −1.866153 | 0.934107 |
| −1.813354 | 0.990799 |
| −1.728705 | 1.070393 |
| −1.668480 | 1.119130 |
| −1.572170 | 1.184111 |
| −1.503964 | 1.220866 |
| −1.432764 | 1.251425 |
| −1.321514 | 1.284880 |
| −1.245259 | 1.298611 |
| −1.129313 | 1.305795 |
| −1.051937 | 1.301771 |
| −0.975190 | 1.291147 |
| −0.862311 | 1.263656 |
| −0.789135 | 1.238202 |
| −0.683136 | 1.190626 |
| −0.615183 | 1.153417 |
| −0.549468 | 1.112386 |
| −0.455053 | 1.044659 |
| −0.394776 | 0.995992 |
| −0.308095 | 0.918609 |
| −0.252665 | 0.864487 |
| −0.199038 | 0.808578 |
| −0.121783 | 0.721779 |
| −0.072260 | 0.662206 |
| −0.000677 | 0.570672 |
| 0.045418 | 0.508408 |
| 0.090359 | 0.445306 |
| 0.155877 | 0.349337 |
| 0.198481 | 0.284635 |
| 0.261098 | 0.186746 |
| 0.302149 | 0.121048 |
| 0.342758 | 0.055076 |
| 0.403052 | −0.044260 |
| 0.442930 | −0.110677 |
| 0.502263 | −0.210591 |
| 0.541475 | −0.277402 |
| 0.599744 | −0.377940 |
| 0.638211 | −0.445183 |
| 0.695321 | −0.546384 |

TABLE 10-continued

| 90% Radial Span | |
|---|---|
| X units. (Axial) | Y units. (Circum.) |
| 0.732988 | −0.614079 |
| 0.770321 | −0.681959 |
| 0.825672 | −0.784132 |
| 0.862129 | −0.852486 |
| 0.916132 | −0.955378 |
| 0.951675 | −1.024212 |
| 0.986847 | −1.093236 |
| 1.038904 | −1.197126 |
| 1.073138 | −1.266620 |
| 1.123774 | −1.371211 |
| 1.157061 | −1.441163 |
| 1.190036 | −1.511264 |
| 1.222821 | −1.581453 |
| 1.239256 | −1.616527 |
| 1.255799 | −1.651551 |
| 1.268312 | −1.677769 |
| 1.280893 | −1.703955 |
| 1.293361 | −1.730194 |
| 1.304803 | −1.756897 |
| 1.311589 | −1.785145 |
| 1.309847 | −1.814143 |
| 1.298405 | −1.840852 |
| 1.278744 | −1.862254 |
| 1.252885 | −1.875517 |
| 1.224058 | −1.879136 |
| 1.186675 | −1.869481 |
| 1.170560 | −1.858615 |
| 1.146240 | −1.828550 |
| 1.136691 | −1.811710 |
| 1.117567 | −1.778032 |
| 1.107416 | −1.761538 |
| 1.086691 | −1.728814 |
| 1.076384 | −1.712418 |
| 1.045792 | −1.663022 |
| 1.005063 | −1.597124 |
| 0.963941 | −1.531471 |
| 0.922428 | −1.466064 |
| 0.859473 | −1.368392 |
| 0.817118 | −1.303527 |
| 0.774480 | −1.238848 |
| 0.709986 | −1.142186 |
| 0.666594 | −1.078010 |
| 0.600829 | −0.982208 |
| 0.556482 | −0.918688 |
| 0.489119 | −0.824002 |
| 0.443604 | −0.761315 |
| 0.374369 | −0.667989 |
| 0.327545 | −0.606272 |
| 0.280166 | −0.544982 |
| 0.207986 | −0.453915 |
| 0.159076 | −0.393838 |
| 0.084439 | −0.304775 |
| 0.033760 | −0.246182 |
| −0.017732 | −0.188302 |
| −0.096633 | −0.102994 |
| −0.150430 | −0.047250 |
| −0.233054 | 0.034457 |
| −0.289493 | 0.087524 |
| −0.347073 | 0.139351 |
| −0.435762 | 0.214429 |
| −0.496563 | 0.262438 |
| −0.590462 | 0.330886 |
| −0.654989 | 0.373757 |
| −0.721174 | 0.414024 |
| −0.823677 | 0.468743 |
| −0.894168 | 0.500884 |
| −1.002984 | 0.541614 |
| −1.077398 | 0.563176 |
| −1.153080 | 0.579744 |
| −1.268417 | 0.593694 |
| −1.345894 | 0.594467 |
| −1.461226 | 0.580717 |
| −1.536187 | 0.561078 |
| −1.609708 | 0.536685 |
| −1.720755 | 0.502485 |
| −1.796963 | 0.488442 |

TABLE 10-continued

| 90% Radial Span | |
|---|---|
| X units. (Axial) | Y units. (Circum.) |
| −1.913058 | 0.491766 |
| −1.983536 | 0.524357 |

TABLE 11

| 100% Radial Span | |
|---|---|
| X units. (Axial) | Y units. (Circum.) |
| −1.936551 | 0.619371 |
| −1.988345 | 0.676786 |
| −1.994449 | 0.790670 * |
| −1.968240 | 0.862644 |
| −1.908108 | 0.960550 |
| −1.860647 | 1.020684 |
| −1.809099 | 1.077389 |
| −1.724786 | 1.155486 |
| −1.663935 | 1.202074 |
| −1.565967 | 1.262136 |
| −1.496509 | 1.294535 |
| −1.424206 | 1.319958 |
| −1.311948 | 1.344489 |
| −1.235638 | 1.351620 |
| −1.120783 | 1.348222 |
| −1.044983 | 1.336900 |
| −0.970475 | 1.318950 |
| −0.862116 | 1.280683 |
| −0.792638 | 1.248340 |
| −0.692994 | 1.191076 |
| −0.629682 | 1.147900 |
| −0.568831 | 1.101320 |
| −0.481956 | 1.026068 |
| −0.426739 | 0.972932 |
| −0.347459 | 0.889712 |
| −0.296727 | 0.832281 |
| −0.247537 | 0.773523 |
| −0.176323 | 0.683301 |
| −0.130335 | 0.622005 |
| −0.063179 | 0.528722 |
| −0.019376 | 0.465847 |
| 0.023854 | 0.402577 |
| 0.087954 | 0.307167 |
| 0.130404 | 0.243370 |
| 0.193986 | 0.147615 |
| 0.236240 | 0.083688 |
| 0.278176 | 0.019553 |
| 0.340278 | −0.077169 |
| 0.381079 | −0.142032 |
| 0.441403 | −0.239873 |
| 0.481062 | −0.305441 |
| 0.520297 | −0.371263 |
| 0.578412 | −0.470432 |
| 0.616706 | −0.536807 |
| 0.673543 | −0.636714 |
| 0.711075 | −0.703521 |
| 0.748354 | −0.770471 |
| 0.803863 | −0.871122 |
| 0.840627 | −0.938356 |
| 0.895427 | −1.039395 |
| 0.931733 | −1.106877 |
| 0.967861 | −1.174454 |
| 1.021729 | −1.275993 |
| 1.057427 | −1.343798 |
| 1.110642 | −1.445681 |
| 1.145694 | −1.513823 |
| 1.180189 | −1.582249 |
| 1.197268 | −1.616546 |
| 1.214278 | −1.650877 |
| 1.222765 | −1.668052 |
| 1.239541 | −1.702496 |
| 1.247694 | −1.719830 |
| 1.262567 | −1.755132 |
| 1.267199 | −1.773750 |

TABLE 11-continued

| 100% Radial Span | |
|---|---|
| X units. (Axial) | Y units. (Circum.) |
| 1.265227 | −1.811896 |
| 1.252612 | −1.837732 |
| 1.231586 | −1.857340 |
| 1.204962 | −1.868185 |
| 1.176248 | −1.869530 |
| 1.140244 | −1.856816 |
| 1.125375 | −1.844621 |
| 1.103292 | −1.813361 |
| 1.093952 | −1.796641 |
| 1.074475 | −1.763655 |
| 1.059449 | −1.739161 |
| 1.044431 | −1.714662 |
| 1.034453 | −1.698308 |
| 1.004573 | −1.649215 |
| 0.964503 | −1.583898 |
| 0.923887 | −1.518918 |
| 0.862293 | −1.421872 |
| 0.820842 | −1.357422 |
| 0.778994 | −1.293230 |
| 0.715394 | −1.197486 |
| 0.672401 | −1.134054 |
| 0.606957 | −1.039561 |
| 0.562697 | −0.977007 |
| 0.517967 | −0.914788 |
| 0.450054 | −0.822053 |
| 0.404258 | −0.760615 |
| 0.334748 | −0.669071 |
| 0.287840 | −0.608478 |
| 0.240456 | −0.548255 |
| 0.168454 | −0.458659 |
| 0.119811 | −0.399449 |
| 0.045845 | −0.311467 |
| −0.004159 | −0.253402 |
| −0.054742 | −0.195840 |
| −0.131740 | −0.110499 |
| −0.183848 | −0.054314 |
| −0.263218 | 0.028825 |
| −0.316960 | 0.083449 |
| −0.371391 | 0.137387 |
| −0.454497 | 0.216792 |
| −0.511003 | 0.268551 |
| −0.597634 | 0.344093 |
| −0.656829 | 0.392756 |
| −0.717371 | 0.439733 |
| −0.811010 | 0.506384 |
| −0.875535 | 0.547723 |
| −0.975949 | 0.603635 |
| −1.045477 | 0.635865 |
| −1.117077 | 0.663186 |
| −1.228138 | 0.692686 |
| −1.304119 | 0.702784 |
| −1.418946 | 0.699458 |
| −1.493946 | 0.683611 |
| −1.566069 | 0.657750 |
| −1.673823 | 0.617732 |
| −1.748437 | 0.600140 |
| −1.863255 | 0.596539 |
| −1.936551 | 0.619371 |

Figure 2:
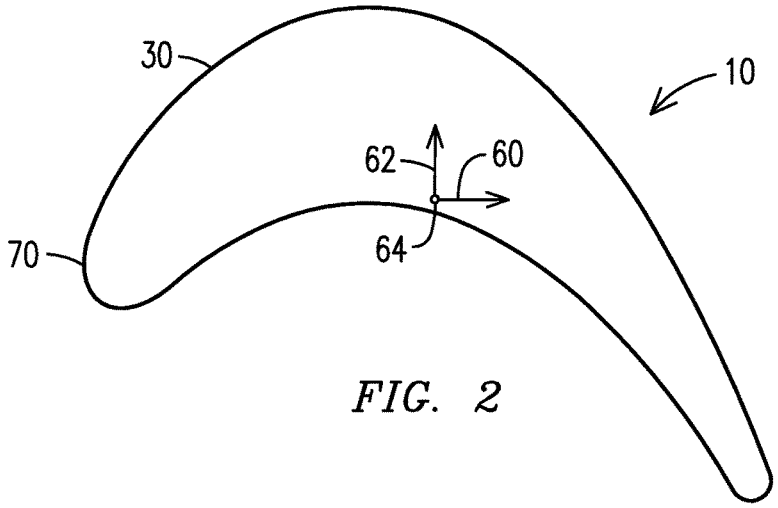
FIG. 2 shows a nominal 0% radial profile of the airfoil of FIG. 1.

FIG. 2 shows the nominal 0% profile 30 of the airfoil substrate 10, where the nominal X and Y coordinates are oriented with respect to an X axis 60 and a y axis 62. A Z axis 64 runs perpendicular to the radial cross section (in and out of the page) along which the various nominal radial profiles are located. A lowest nominal X value in Table 1 (−2.441473) defines a 0% radial leading edge point 70 with an associated 0% radial leading edge point nominal Y value (−0.516103 as indicated by an asterisk next to the value in Table 1). A change in the leading edge point nominal Y values associated respective nominal radial profiles can be associated with an amount of openness of the airfoil. In this case, the greater the change in leading edge point nominal Y value from the 0% radial to another radial, the greater the openness of the blade 22.

Figure 3:
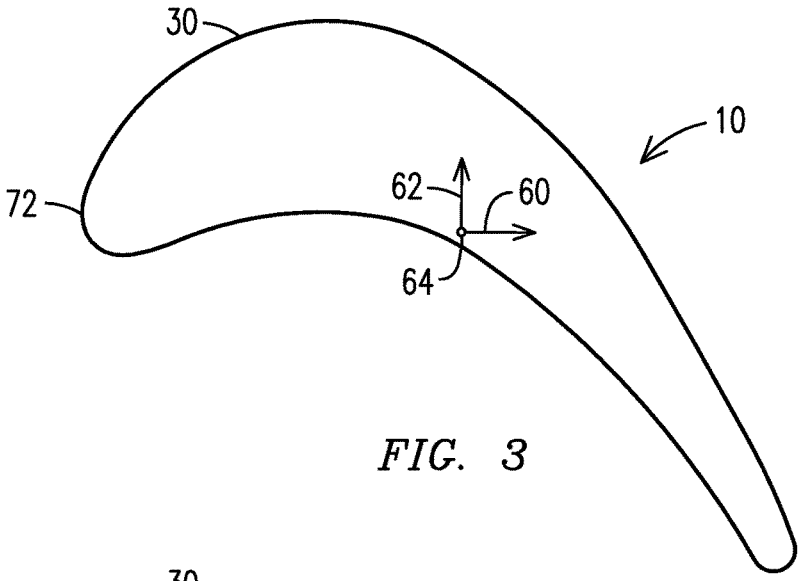
FIG. 3 shows a nominal 50% radial profile of the airfoil of FIG. 1.

For example, FIG. 3 shows the nominal 50% profile 40 of the airfoil substrate 10. A lowest nominal X value in Table 6 (−2.203616) defines a 50% radial leading edge point 72 with an associated 50% radial leading edge point nominal Y value (0.310640 as indicated by an asterisk next to the value in Table 6). Thus, the airfoil substrate 10 disclosed herein is characterized by a change of at least 0.83 units (0.310640 minus −0.516103) between the 0% radial leading edge point nominal Y value and the 50% radial leading edge point nominal Y value. In variations of the airfoil nominal profile a greater change may be sought for various aerodynamic reasons.

Figure 4:
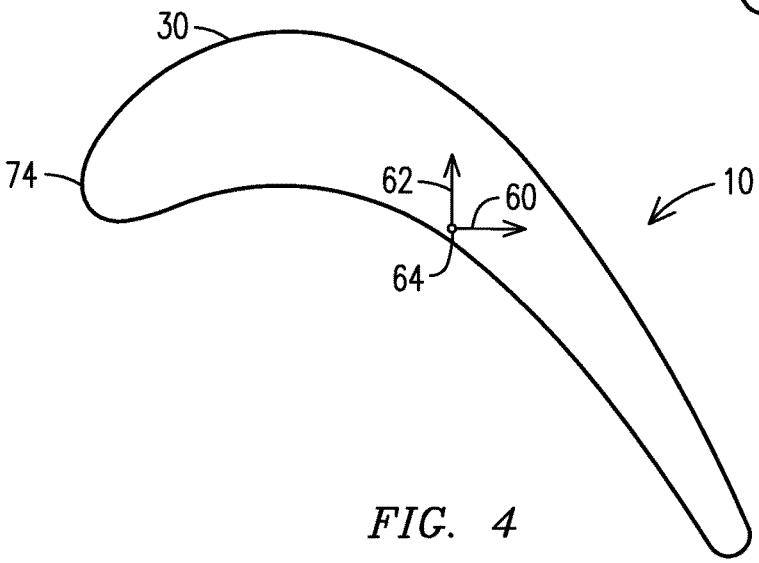
FIG. 4 shows a nominal 100% radial profile of the airfoil of FIG. 1.

FIG. 4 shows the nominal 100% profile 50 of the airfoil substrate 10. A lowest nominal X value in Table 10 (−1.994449) defines a 100% radial leading edge point 74 with an associated 100% radial leading edge point nominal Y value (0.790670 as indicated by an asterisk next to the value in Table 11). Thus, the airfoil substrate 10 disclosed herein is characterized by a change of at least 1.31 units (0.790670 minus −0.516103) between the 0% radial leading edge point nominal Y value and the 100% radial leading edge point nominal Y value. Here again, in variations of the airfoil nominal profile a greater change may be sought for various aerodynamic reasons. While only the nominal 50% and 100% radial profiles have been described in this manner, each nominal radial profile can similarly be characterized and differences between the radial relevant leading edge point nominal Y values can be determined.

Figure 5:
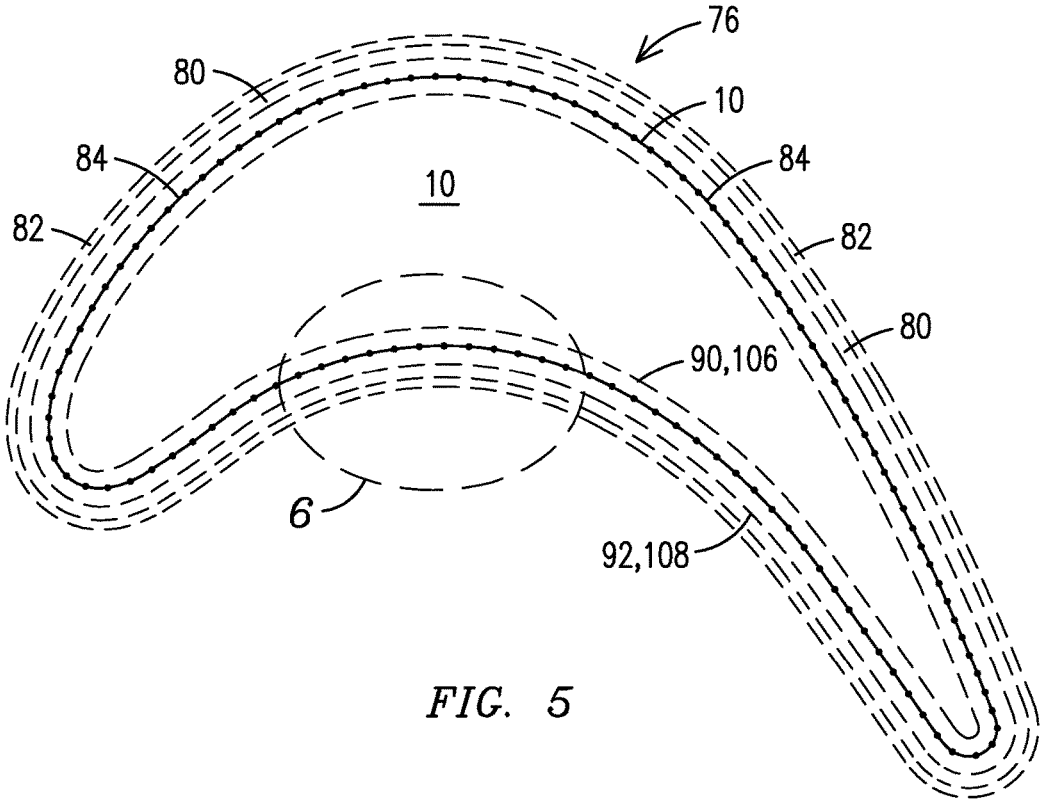
FIG. 5 shows a radial cross section of the airfoil of FIG. 1 with coating layers.
Figure 6:
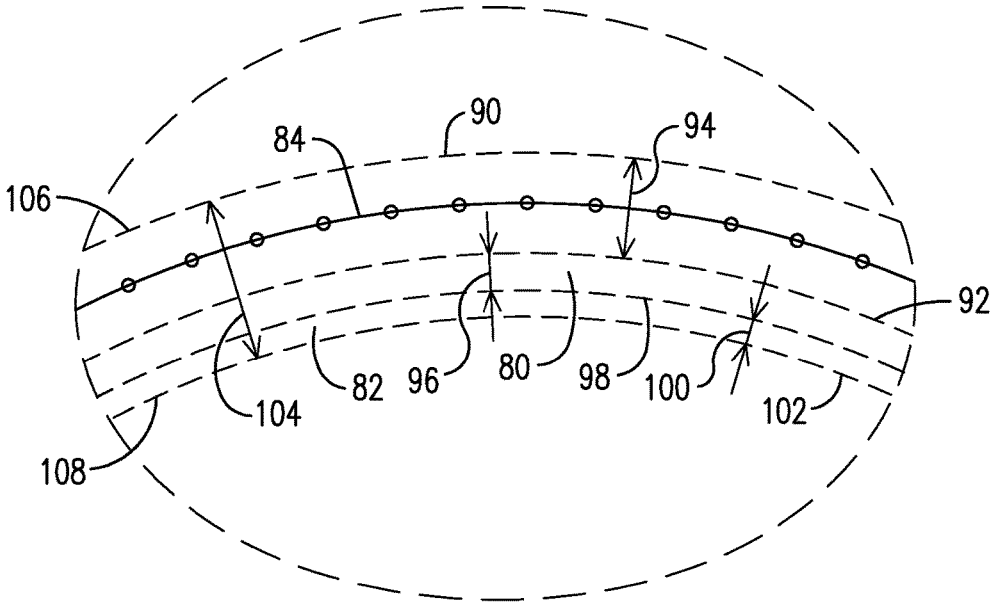
FIG. 6 shows a close up of a portion of the cross section of FIG. 5.

FIG. 5 shows a radial cross section of the airfoil substrate 10 of FIG. 1 with coating layers applied, to form a coated airfoil 76. Exemplary coating layers may include a bond coat 80, a thermal barrier coating (TBC), and any other coating known to those in the art. FIG. 6 is a close up of a portion of the cross section of the airfoil substrate 10 of FIG. 5. A nominal profile 84 fully represents the airfoil substrate 10 at the radial location by connecting the associated nominal X and Y coordinates via smooth, continuing curves to form a smooth, continuous airfoil shape. A manufacturing tolerance is bounded by a maximum inward variation 90 from the nominal profile 84 and a maximum outward variation 92 from the nominal profile 84. An acceptable manufacturing tolerance for the cast airfoil substrate is +/−0.015 inches in a direction normal to the nominal profile 84 at that location. Thus, the maximum inward variation 90 is 0.015 inches normal to the nominal profile 84 and inward at that location. Likewise, the maximum outward variation 92 is 0.015 inches normal to the nominal profile 84 and outward at that location. The maximum inward variation 90 and the maximum outward variation 92 thereby define a manufacturing tolerance envelope 94 for the airfoil substrate 10 which is, in the case of a cast airfoil substrate 10, 0.030 inches. In the exemplary embodiment (the baseline configuration) of FIG. 6 the X and Y coordinates represent inches. However, if the units change, and therefore if the absolute size of the nominal profile 84 changes when scaling the size up or down, the manufacturing tolerance envelope 94 remains the same. For example, if the absolute size of the airfoil substrate 10 is doubled, the manufacturing tolerance for the cast airfoil substrate 10 (alone) of +/−0.015 inches remains the same.

The bond coat 80 is shown as applied to the airfoil substrate 10 when the actual profile is disposed at the line representing the maximum outward variation 92, (i.e. when the airfoil substrate 10 is at the largest end of its manufacturing tolerance.) A thickness 96 of the bond coat 80 may vary from 0.006 inches up to 0.020 inches normal to the actual profile at that location. The TBC 82 is shown as applied a surface 98 of the bond coat 80. A thickness 100 of the TBC may also vary from 0.010 inches, and can reach up to 0.025 inches normal to the bond coat surface 98 at that location. Thus, a TBC surface 102 as shown in FIG. 6 represents the largest actual profile an airfoil substrate 10 manufactured to the nominal X and Y values in Tables 1-11, and then coated with an MCrAlY and a TBC, may actually attain.

A radial envelope 104 that spans from the maximum inward variation 90 of a bare airfoil substrate 10 to the TBC surface 102 shown therefore represents a range of actual profiles that may be manufactured using the nominal X and Y values in Tables 1-11 (i.e. based on the nominal X and Y values in Tables 1-11.) In particular, an inward boundary 106 of the radial envelope 104, defined by the maximum inward variation 90, represents the smallest airfoil substrate 10 that manufacturing tolerance will permit. Consequently, the inward boundary is 0.015 inches normal to the nominal profile 84 and inward at a given location. An outward boundary 108 of the radial envelope 104, defined by the TBC surface 102 in FIG. 6, represents a largest actual profile that manufacturing tolerance will permit. The largest actual profile is that of the largest uncoated substrate manufacturing tolerance will permit, which is then coated with a bond coat that is 0.020 inches thick, which is, in turn, coated with a TBC that is 0.025 inches thick. Consequently, the outward boundary 108 is 0.060 inches (0.015 inches manufacturing tolerance of the casting plus 0.020 inches maximum bond coat thickness plus 0.025 inches maximum TBC thickness) normal to the nominal profile 84 and inward at a given location. The tolerance can range of an airfoil that may be produced from the tables can then be expressed at −0.015 to +0.060 inches from the nominal profile. The airfoils that may be produced range from a bare substrate at a low end of its manufacturing tolerance, to a substrate at a top end of its manufacturing tolerance and coated with a bond coat having a maximum bond coat thickness, and also coated with a TBC having a maximum TBC coating thickness.

Figure 7:
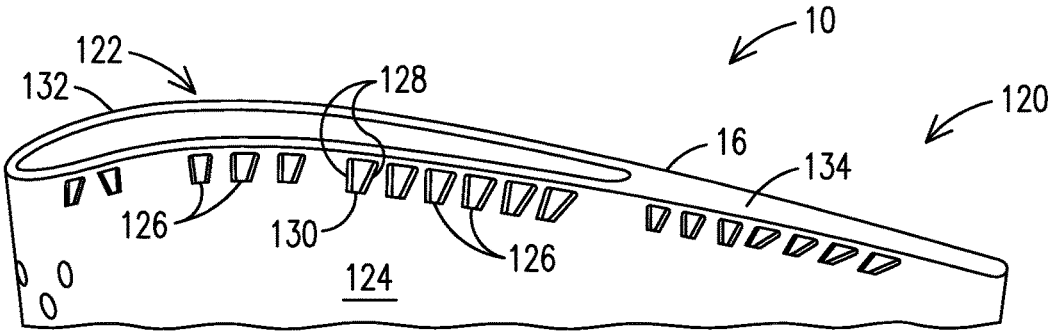
FIG. 7 shows a tip cooling arrangement for the airfoil of FIG. 1.

The airfoil substrate 10 nominal profiles result in improved aerodynamics from prior art airfoil profiles. In addition, the airfoil substrate 10 may include a tip film cooling arrangement 120, shown in FIG. 7, to improve cooling and thermo-mechanical fatigue life of a tip region 122 of the airfoil substrate 10. The tip film cooling arrangement 120 may be necessary to make the improved aerodynamics possible. For example, manufacturing costs associated with forming the tip film cooling arrangement 120 may be deemed acceptable when the increased efficiency of the profiles disclosed herein is considered. The tip film cooling arrangement 120 may be disposed on a pressure side 124 of the airfoil substrate 10, near the tip 16. An array of individual film cooling holes 126 are formed in the pressure side 124 and may have a traditional 10-10-10 shape angle orientation between sides 128 and lower portion 130 of the film cooling hole 126 as is known to those in the art. The film cooling holes 126 receive cooling air from a supply channel internal to the airfoil substrate 10 and are sufficiently proximate the tip 16 of the airfoil substrate 10 to provide film cooling coverage along the tip 16 and to a tip squealer tip rail 132 and tip cap outer surfaces 134. This arrangement improves the film cooling and this, in turn, increases the thermo-mechanical fatigue life of the tip 16, particularly on the pressure side 124 of the airfoil substrate 10. Specifically, high temperature oxidation, loss of material, and cracking, are reduced in this region.

The aerodynamics of the airfoil disclosed herein result in a relatively higher incidence tolerance, meaning improved robustness local to a leading edge of the airfoil. This allows for better airfoil aerodynamic performance with varying gas path flow inlet angles. Further, there is a relatively lower amount of aerodynamic losses on a suction side of the airfoil 10 due to reduced friction on the airfoil surfaces. In addition, there exists a relatively lower peak Mach number local to an airfoil trailing edge region which reduces trailing edge losses, thereby increasing the overall efficiency of the gas turbine engine.

Still further, the stacking of the airfoil disclosed herein generates a relatively lower mechanical load at an interface of the airfoil with an inner platform and at an interface of the airfoil with a root trailing edge region due to centrifugal loading of blade pull during operation. This results in increased fatigue life of these interfaces.

For at least the foregoing reasons, it can be seen that the inventors have created an airfoil profile that represents an improvement in that art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A gas turbine engine blade, comprising:

an airfoil substrate comprising an exterior surface, wherein a base of the airfoil substrate is located at a 0% radial location on an inner platform surface and a tip of the airfoil substrate is located at a 100% radial location, wherein at the 0% radial a cross-sectional profile of the exterior surface is substantially characterized by nominal X and Y coordinates present in Table 1, and wherein at a 50% radial location a cross-sectional profile of the exterior surface is characterized by nominal X and Y coordinates present in Table 6.

2. The gas turbine engine blade of claim 1, wherein at the 100% radial location a cross-sectional profile of the exterior surface is substantially characterized by nominal X and Y coordinates present in Table 11.

3. The gas turbine engine blade of claim 2, wherein at 10%, 20%, 30%, 40%, 60%, 70%, 80%, and 90% radial locations respective cross sectional profiles of the exterior surface are substantially characterized by nominal X and Y coordinates present in Tables 2, 3, 4, 5, 7, 8, 9, and 10 respectively.

4. The gas turbine engine blade of claim 1, wherein the nominal X and Y coordinates represent dimensions in inches.

5. The gas turbine engine blade of claim 1, further comprising a tip film cooling arrangement comprising an array of film cooling holes disposed on a pressure side of the airfoil substrate proximate the tip of the airfoil substrate.

6. The gas turbine engine blade of claim 5, wherein the tip film cooling holes comprise a 10-10-10 shape angle orientation.

7. The gas turbine engine blade of claim 1, further comprising a bond coat disposed on the airfoil substrate, and a thermal barrier coating disposed on the bond coat.

8. A gas turbine engine comprising a turbine, wherein a first stage of the turbine comprises the gas turbine engine blade of claim 1.

9. A gas turbine engine blade, comprising:

an airfoil substrate comprising an exterior surface, wherein a base of the airfoil substrate is located at a 0% radial location on an inner platform and a tip of the airfoil substrate is located at a 100% radial location, wherein at the 0% radial location a cross-sectional profile of the exterior surface is substantially characterized by nominal X and Y coordinates present in Table 1, and wherein a lowest nominal X value in Table 1 defines a 0% radial leading edge point and a 0% radial leading edge point nominal Y value;

wherein at a 50% radial location a cross-sectional profile of the exterior surface comprises a 50% radial leading edge point characterized by a lowest nominal X value in Table 6.

10. The gas turbine engine blade of claim 9, wherein at the 100% radial location radial a cross-sectional profile of the exterior surface comprises a 100% radial leading edge point characterized by a lowest nominal X value in Table 11.

11. The gas turbine engine blade of claim 9, wherein the nominal X and Y coordinates represent dimensions in inches.

12. The gas turbine engine blade of claim 9, further comprising a tip film cooling arrangement comprising an array of film cooling holes disposed on a pressure side of the airfoil substrate proximate the tip of the airfoil substrate.

13. The gas turbine engine blade of claim 9, further comprising a bond coat disposed on the airfoil substrate, and a thermal barrier coating disposed on the bond coat.

14. A gas turbine engine blade, comprising:

an airfoil comprising an exterior surface, wherein a base of the airfoil is located at a 0% radial location on an inner platform surface and a tip of the airfoil is located at a 100% radial location, wherein at the 0% radial location a cross-sectional profile of the exterior surface lies within a 0% radial envelope based on nominal X and Y coordinates present in Table 1, wherein at a 50% radial location a cross-sectional profile of the exterior surface lies within a 50% radial envelope based on nominal X and Y coordinates present in Table 6, wherein respective envelopes are defined by a respective nominal profile connecting respective nominal X and Y coordinates, minus an maximum inward variation of 0.015 inches inward from the respective nominal profile in a direction normal to the surface at that location, and plus a maximum outward variation of 0.060 inches outward from the respective nominal profile in a direction normal to the surface at that location.

15. The gas turbine engine blade of claim 14, wherein at the 100% radial location a cross-sectional profile of the exterior surface lies within a 100% radial envelope based on nominal X and Y coordinates present in Table 11, and wherein the 100% radial envelope is defined by a nominal 100% radial profile connecting respective nominal X and Y coordinates, minus an maximum inward variation of 0.015 inches inward from the nominal 100% radial profile in a direction normal to the surface at that location, and plus a maximum outward variation of 0.060 inches outward from the nominal 100% radial profile in a direction normal to the surface at that location.

16. The gas turbine engine blade of claim 15, wherein at 10%, 20%, 30%, 40%, 60%, 70%, 80%, and 90% radial locations respective cross sectional profiles of the exterior surfaces lie within radial envelopes based on nominal X and Y coordinates present in Tables 2, 3, 4, 5, 7, 8, 9, and 10 respectively, and wherein respective envelopes are defined by a respective nominal profile connecting respective nominal X and Y coordinates, minus an maximum inward variation of 0.015 inches inward from the respective nominal profile in a direction normal to the surface at that location, and plus a maximum outward variation of 0.060 inches outward from the respective nominal profile in a direction normal to the surface at that location.

17. The gas turbine engine blade of claim 14, wherein the airfoil consists of a casting.

18. The gas turbine engine blade of claim 14, further comprising a bond coat disposed on an airfoil substrate.

19. The gas turbine engine blade of claim 18, further comprising a TBC disposed on the bond coat.

20. The gas turbine engine blade of claim 14, further comprising a tip film cooling arrangement comprising an array of film cooling holes disposed on a pressure side of the airfoil proximate the tip of the airfoil.

* * * * *